United States Patent [19]

Budrean et al.

[11] Patent Number: 4,559,802

[45] Date of Patent: Dec. 24, 1985

[54] METHOD FOR DRAWING HEAVY WALL SHELLS

[75] Inventors: John D. Budrean, DeMotte, Ind.; John A. Kirkpatrick, Chicago Heights, Ill.

[73] Assignee: Verson Allsteel Press Company, Chicago, Ill.

[21] Appl. No.: 698,370

[22] Filed: Feb. 5, 1985

Related U.S. Application Data

[62] Division of Ser. No. 408,015, Aug. 13, 1982, Pat. No. 4,509,356.

[51] Int. Cl.[4] ..... B21D 22/00

[52] U.S. Cl. ..... 72/349; 72/375; 72/405

[58] Field of Search ..... 72/347, 342, 349, 404, 72/405, 372, 375, 379

[56] References Cited

U.S. PATENT DOCUMENTS 1,412,196 4/1922 Rabold .
3,893,326 7/1975 Oberlander et al. ..... 72/347
3,998,087 12/1976 Schumacher ..... 72/405
4,147,049 4/1979 Book .

FOREIGN PATENT DOCUMENTS 1932139 1/1971 Fed. Rep. of Germany .
1253845 1/1961 France .
1602539 11/1981 United Kingdom .

*Primary Examiner*—Leon Gilden
*Attorney, Agent, or Firm*—Jerry W. Mills; Gregory M. Howison

[57] ABSTRACT

A forming machine (10) is provided for forming a finished part (12) from a flat blank (14). Draw stations (18–24) are provided to initially form the intermediate part. Each draw station includes a punch (44, 62, 66, 70) and a draw die (48, 64, 68, 72). Each punch defines a shoulder along its length to create a step (60) in the side walls (26) of the intermediate part. In the subsequent necking and final form stages (30, 32, 34) the punch employed also has a shoulder to permit variation of the force applied to the intermediate part between the step and bottom portion.

6 Claims, 14 Drawing Figures

METHOD FOR DRAWING HEAVY WALL SHELLS

This is a divisional of application Ser. No. 408,015, filed Aug. 13, 1982, now U.S. Pat. No. 4,509,356.

TECHNICAL FIELD

The present invention relates to the forming of metal, and in particular to the forming of metal by drawing.

BACKGROUND ART

The drawing of metals into a variety of shapes is a well-known metal forming process. These shapes include cylindrical cups and tubes with curved side walls as well as shapes with angular side walls, with square or rectangular cross sections, for example. Countless numbers of items are produced by this process, with one example being a grenade body. Typical metals used in the process are carbon steel, alloy steel, aluminum, and brass, as well as other types of metals.

A common shape desired to be formed by drawing is essentially a cylindrical cup formed by a cylinder with one end closed. The cup may be drawn in a single or multistage process. Each stage includes a punch which drives the metal to be formed into a die to form an intermediate or final shape. In the typical multistage process, the metal is processed through a number of draw stations and completed in a series of finishing stations. The number of draw stations required depends upon the inside diameter of the cylinder, the height of the cylinder, metal thickness and physical properties of the metal.

Previously known punch and die forming machines are adequate to form cup shapes when the desired end configuration does not need to be sharply defined with very close dimensional tolerances. With thicker materials, the prior known machines are not adequate. With such thick material, the punch is pressing against a small cross section at the bottom of the drawn part while pulling the part through the die. This imposes a tensile stress in the cylindrical portion of the cup. If the tensile stress in the cylindrical portion exceeds the ultimate tensile strength of the material, the bottom of the cup will separate from the cylinder, thereby resulting in a defective part. Even though ultimate failure may not occur, excessive thinning of portions of the cup and cracks and splits can occur.

A prior attempt to eliminate problems in drawing is disclosed in U.S. Pat. No. 4,147,049 issued to Book et al. on Apr. 3, 1979. This patent discloses the use of supplemental sleeves which assist a punch in drawing a cup into a die by contacting the open end of the cylindrical cup to reduce the tensile stress in the cylindrical portion of the cup. However, with such a prior technique, the open end of the cylindrical cup drawn does not always remain perfectly square with the axis of the cylinder. Depending on the properties of the metal drawn and the ratio of length to diameter of the drawn part, the open end may have an irregular or wavy surface of variable severity so that the supplemental sleeves do not provide a uniform compensating stress within the cylindrical portion of the cup. The height of these irregularities varies from part to part and it is therefore impossible to apply a constant force on each part.

A need exists to overcome the above recorded problems in drawing metal. In particular, a need exists to reduce the tensile stress in the side wall portions of a drawn piece to permit precisely controlled shaping held to extremely close tolerances and even permit changes in thickness of metal within a closed end of the piece.

DISCLOSURE OF THE INVENTION

In accordance with one aspect of the present invention, an apparatus is provided for forming a material into a cup part having side walls and a bottom portion. The apparatus includes at least one stage of forming. The stage includes a die and cooperating punch to draw the material through the die to form the cup part. The punch has a nose portion for contacting the bottom portion of the cup part and an enlarged portion for forming an annular surface on the side walls perpendicular to the axis of the drawn cup part.

In accordance with another aspect of the present invention, an apparatus is provided which includes at least one draw stage of forming for forming a cup part from a material. Each of the draw stages includes a draw die and cooperating punch to draw the material through the draw die to form the cup part. The punch includes a nose portion of relatively reduced diameter for contacting the bottom portion of the cup part and a relatively enlarged diameter for forming a step in the side walls of the drawn cup part. At least one finishing stage of forming is provided to form the bottom portion. The finishing stage includes a finishing die and cooperating punch to form the material through the finishing die. The punch includes structure for contacting the step in the side walls of the drawn cup part to control the stresses in the side walls.

In accordance with yet another aspect of the present invention, a method for forming a material into a cup part having side walls and a bottom portion is provided. The method includes the step of forming the material at least one stage. The stage includes a die and cooperating punch to draw the material through the die to form the cup part. The punch has a nose portion for contacting the bottom portion of the cup part and an enlarged portion for forming an annular surface on the side walls perpendicular to the axis of the drawn cup part.

BRIEF DESCRIPTION OF THE DRAWINGS

A more complete understanding of the invention may be had by reference to the following Detailed Description taken in conjunction with the accompanying Drawings, wherein.

DETAILED DESCRIPTION

Figure 1:
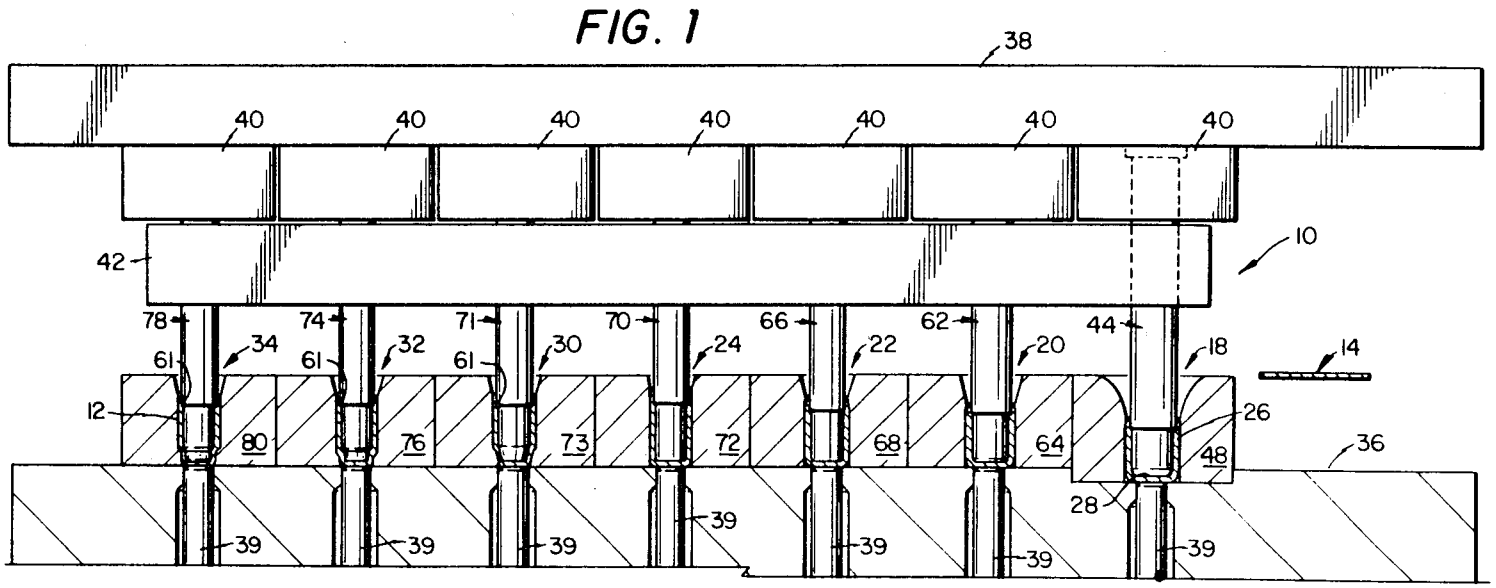
FIG. 1 is a partial side cross-sectional view of a forming machine incorporating the teachings of the present invention.

Referring now to the drawings, wherein like reference characters designate like or corresponding parts throughout several views, FIG. 1 illustrates a forming machine 10 for forming a finished cup part 12 from a circular plate-like blank material 14. Cup part 12 may have any desired cross section, while the material 14 can comprise any formable metal or other formable material.

The forming machine 10 performs three major formation functions which can include one or more individual forming stations. The first function is the drawing of the material 14 at the first draw station 18, second draw station 20, third draw station 22 and fourth draw station 24. Each draw station progressively decreases the diameter of the intermediate cup part shape and increases the length of the side walls 26. The thickness of both side walls 26 and bottom portion 28 remain substantially the same. The number of draw stations varies with part size and material and four draw stations are shown merely as an example.

The bottom portion 28 of the finished cup part 12 is formed in the final two formation functions. The second formation function is performed by first necking stage 30 and second necking stage 32 which act primarily to form the bottom portion 28. The number of necking stages is dependent upon the complexity of the bottom portion configuration. The third formation function is performed by a final form station 34 which forms the final shape of bottom portion 28.

The forming machine 10 includes a lower die shoe 36 which is typically stationary. An upper die shoe 38 is supported for vertical motion above the lower die shoe 36. Each of the stations include a punch, a die and an ejector pin 39. The punches for the stations are located by punch holders 40 secured to the upper die shoe 38. Each of the dies are located on the lower die shoe 36. Die and punch loads are supported by the lower die shoe 36 and upper die shoe 38, respectively. The ejector pins 39 at each stage are movable relative to the associated dies to remove a formed intermediate or final cup part from the die. The ejector pins 39 lift the formed final or intermediate cup parts free of the dies as seen in FIG. *2h*. The pins 39 can also function to support bottom portion 28, or so called "coining" loads. The coining load is supported by lower die shoe 36. The pins 39 could be operated by mechanical cam operation, air cylinders or nitrogen or hydraulic cushions at each station, or a cross bar actuated by two cushions in the bed of the machine 10. A stripper 42 is provided with apertures to permit passage of the punches therethrough for stripping the formed intermediate or final cup part from the punch. Stripper 42 can be substituted for by lever type strippers at each station, cross bar knockouts provided in the slide of the machine 10 or another suitable type. An individual finished cup part 12 is formed from material 14 by moving the piece sequentially through each stage from right to left as seen in FIG. 1. Apparatus for performing this transfer is well-known in the art and will not be described.

The punch 44 employed in the first draw station 18 is formed with a relatively reduced diameter nose portion 45 and a relatively enlarged diameter portion 46 as best seen in FIG. *2a*. The draw die 48 has an upper die surface 50 having a wide flare and a relatively straight lower die surface 52 separated by the minor diameter 54. The dimensions of surface 52 and diameter 54 can vary, and in some die designs can be identically sized.

The pressure applied by the descending punch 44 initially deforms the material 14 as shown in FIG. *2b* to fit into the contour of the upper die surface 50 of the draw die 48. As the punch 44 continues to descend, it pulls the material through the minor diameter 54 of the draw die 48 to form essentially a straight wall intermediate cup shape as illustrated in the sequence of FIGS. *2c–h*.

During this draw process, the punch 44 is pressing against a small cross section of the bottom portion 28 of the material being drawn through the draw die 48. This imposes a tensile stress in the side walls 26 of the immediate cup part. The contour of the die surfaces 50 and 52 are carefully developed to suit the metal thickness and particular metal to be formed and is an important consideration in the design of the die.

It can be readily observed from FIGS. 1 and 2 that the interface between the nose portion 45 and enlarged diameter portion 46 forms an annular surface 56 on the punch 44 perpendicular the motion of the punch. The annular surface 56 can be sharply defined, as seen in the upper detail view in FIG. *2a* or have a more gradual definition as seen in the lower detail view of FIG. *2a*. The annular surface 56 can be formed by fitting a sleeve over a punch with the same outer diameter as nose portion 45. The length of the nose portion 45 is designed so that the enlarged diameter portion 46 passes the minor diameter 54 of the draw die 48 before the open end 58 of the intermediate cup part passes through the minor diameter 54. The clearance between the outside diameter of the enlarged diameter portion 46 and the minor diameter 54 is less than the metal thickness of the intermediate cup part. Therefore, the final relatively small amount of material that passes through the draw die is reduced in wall thickness to create an annular surface or step 60 at the open end as best seen in FIG. *3a*. However, the step 60 can be formed at any position along side walls 26 desired and need not be near the open end. For example, the specification of a part may require an annular step to be formed on the side wall in the final shape. In the past, a separate machining step would be required to form this step. Under the teachings of the present invention, the annular surface 56 can be positioned to form the step at the specified position. The distance from the material contacting surface of the nose portion 45 and the step 60 is precisely controlled. The step is formed perpendicular and concentric to the axis of the drawn intermediate cup part and motion of direction of punch 44. The volume of material within the intermediate cup part below the step 60 is therefore established precisely which is critical for controlling part definition in subsequent operations.

The second draw stage 20 includes a punch 62 and draw die 64. The third draw station 22 includes a punch 66 and a draw die 68. The fourth draw station 24 includes a punch 70 and draw die 72. Each of the punches 62, 66 and 70 also include a nose portion and enlarged diameter portion. The punches and draw dies are designed to progressively decrease the cup diameter and increase the cup length of the intermediate cup part as illustrated in FIGS. *3a–d*. The difference in diameter of the nose portion and enlarged diameter portion at each station progressively increases to increase the amount of step 60 in the drawn cup part, again as best seen in FIGS. *3a–d*. At the completion of the fourth draw, the step 60 in the intermediate cup part has been fully developed. It will be observed that the irregularity of the open end 58 of the intermediate cup parts becomes more severe upon each draw. However, the step 60 formed in the draw processes remains perpendicular and concentric to the axis of the drawn part.

It is not necessary to always increase the difference in diameter of the nose portion and enlarged diameter portion at each station. The step formed in the side walls depends not only on this difference, but on the force transmitted through the punch to the side walls. For example, punches 44 and 62 can have the same diameter difference and punches 66 and 70 have the same, albeit layer, diameter difference. The force exerted on the formed part by punches 44, 62, 66 and 70 can then be varied to achieve the development of the step in four stages as done by the punches illustrated in FIGS. 2*c–h*.

Figure 3E:
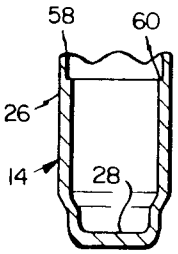
FIGS. 3*a–e* are cross-sectional side views of the cup part formed in each of the draw stages of the forming machine and the final form station.
Figure 3D:
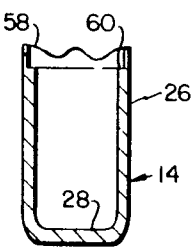
Figure 3C:
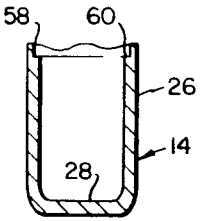
Figure 3B:
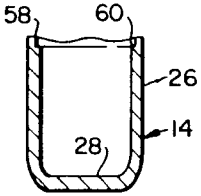
Figure 3A:
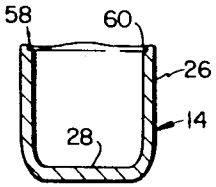
Figure 2A:
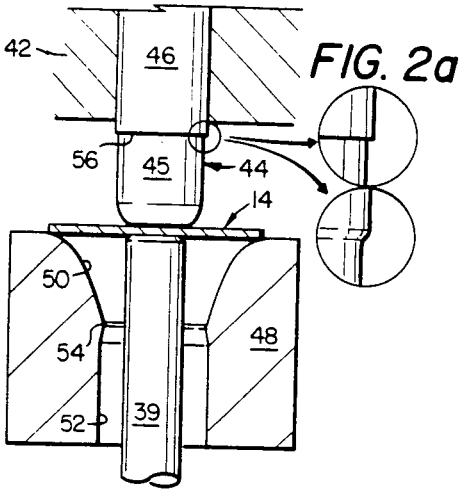
FIGS. 2*a–h* are sequential detail illustrations of the forming of a cup part in one stage of the forming machine.
Figure 2B:
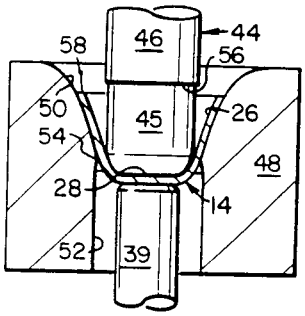
Figure 2C:
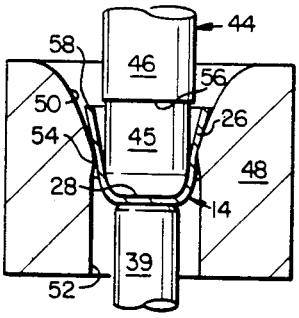
Figure 2D:
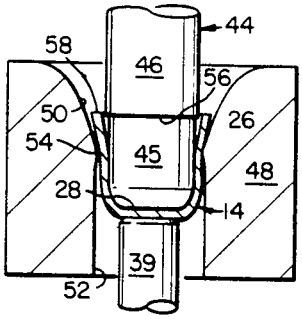
Figure 2E:
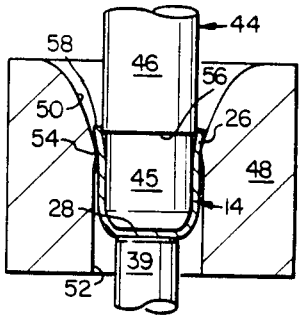
Figure 2F:
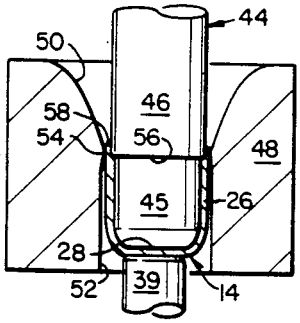
Figure 2G:
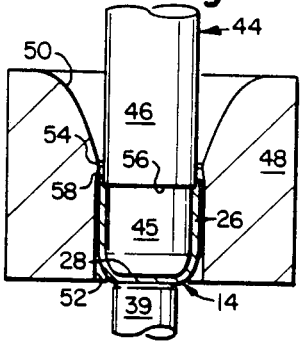
Figure 2H:
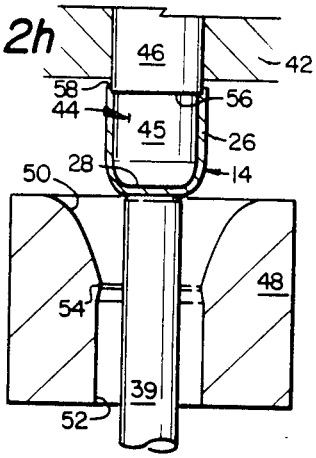

The step 60 at the open end of the intermediate cup part can be used in the subsequent forming of the bottom portion 28 at the first necking station 30, second necking station 32 and final forming station 34 to result in the final form shown in FIG. 3*e*. The first necking station 30 includes a punch 71 and die 72. The second necking station 32 includes a punch 74 and die 76. The final forming station 34 includes a punch 78 and die 80. The term necking refers to the configuration imparted to the bottom portion 28. The number of necking operations are therefore dependent upon the complexity of the configuration desired in the bottom portion 28.

With the step 60, uniform forming pressure can be applied to the side walls adjacent to the open end 58 of the intermediate cup part simultaneously with application of pressure through the nose portion of the punches 71, 74 and 78 at each of the stations 30, 32 and 34. Forming pressure can be applied solely through the side walls if desired. The punches 71, 74 and 78 at each of the stations are made with a relatively reduced diameter nose portion and a relatively enlarged diameter portion. The interface or shoulder 61 on the punches 71, 74 and 78 can be positioned to contact the step 60 to provide the desired ratio of force applied through the step 60 and to the bottom portion 28. It can readily be seen that the precise location of the step 60 established by the draw stations 18–24 and the perpendicularity of step 60 to the axis of the cup part enables application of uniform compressive forces throughout the circumference of the part and consistently for every part formed. The compressive forces applied to the cup part through the step 60 assists greatly to move the material and cause the material to fill the envelope defined by the punch on the inside and the die on the outside thereof. It is also possible to control the amount of compressive forces applied through the cylindrical portion. For example, for some parts it may be desirable to apply all of the forming pressure through the side walls 26 at step 60 and none through the nose portion of the punch to the bottom portion 28.

While the present invention is described and illustrated by the formation of a cylindrical cup shape, many other shapes can be formed by employing the teachings of the present invention. For example, shapes having curved side walls with a non-circular cross section can be formed. Also, shapes having angular side walls can be formed, including shapes with square and rectangular cross sections, and polygon cross sections such as hexagons and octagons. Shapes can also be formed with apertures or holes in the bottom portion. These apertures can be smaller than the inner dimensions of the side walls and have any desired configuration. The apertures can be as large as the inner dimensions of the side walls to form a tubular or duct. Force can be applied through the step in the side walls of the tubular or duct part to form a desired geometric shape to one end of the port.

With a non-circular shape, the step formed in the side walls would not be annular. However, the step would always define a surface perpendicular to the direction of motion of the punch and would closely approximate the cross section of the side walls. The punches and dies would naturally be made to produce the desired part shape and step configuration.

While the present invention has been described with a forming machine having a given number of stages, it is clear the invention may be adapted for use with any number of stations. The present invention is also applicable to parts produced in a single operation vertical or horizontal, mechanical or hydraulic press. The present invention greatly enhances the ability to precisely form complex closed ends and uniform wall thickness by applying forming pressure through both the nose portion of a punch and through compressive forces applied in the cylindrical portion through the step formed therein.

Although only a single embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

We claim:

1. A method of forming a material into a part having side walls comprising the steps of:

contacting the material with a draw punch, said draw punch having a diameter variation along its length to define a draw shoulder;

drawing the material through a draw die with said draw punch to form the material; and forming a step on the side walls of the part between the draw shoulder on said draw punch and said draw die at an angle to the axis of the part; and contacting the part with a finishing punch, said finishing punch having a diameter variation along its length to define a finishing shoulder; and forming the part through a finishing die with said finishing punch, force being applied to the part by contact between said finishing shoulder and said step.

2. The method of claim 1 further for forming a material into a part having side walls and a bottom portion, said step of contacting the material including the step of contacting the bottom portion of the part with a nose portion of said draw punch.

3. The method of claim 1 further for forming a material into a part having side walls and a bottom portion, said step of contacting the part with said finishing punch including the step of contacting the bottom portion of the part with a nose portion on said finishing punch, the position of said finishing shoulder on the finishing punch determining the relative ratio of force applied to the step and bottom portion of the part during forming.

4. The method of claim 1 further comprising the step of forming the part at a plurality of draw stages, the draw shoulder on the draw punch at each successive stage being enlarged to increase definition of the step on the side walls during each stage of drawing.

5. A method for forming a material into a part having side walls and a bottom portion, comprising the steps of:

contacting the bottom portion of the part with the nose portion of a draw punch, said draw punch having an enlarged diameter portion to define a draw shoulder between the nose portion and enlarged diameter portion;

drawing the material through a draw die with said draw punch to form the material;

forming an annular step on the side walls of the part perpendicular and concentric to the axis of symmetry of the part;

contacting the bottom portion of the part with a finishing punch, said finishing punch having a nose portion and an enlarged diameter portion to define a finishing shoulder between the nose portion and the enlarged diameter portion; and forming the part through a finishing die with said finishing punch, the finishing shoulder on said finishing punch being positioned to transmit preselected forces to the part through the step on the part while the part is formed through said finishing die.

6. The method of claim 5 further comprising the step of forming the part at a plurality of draw stages, the width of the draw shoulder at each successive draw stage being enlarged to increase the size of the step during each stage of drawing.

* * * * *